US010851654B2

(12) United States Patent
Burbaum

(10) Patent No.: US 10,851,654 B2
(45) Date of Patent: Dec. 1, 2020

(54) ARRANGEMENT FOR A TURBINE

(71) Applicant: Siemens Aktiengesellschaft, Munich (DE)

(72) Inventor: Bernd Burbaum, Falkensee (DE)

(73) Assignee: Siemens Aktiengesellschaft, Munich (DE)

( * ) Notice: Subject to any disclaimer, the term of this patent is extended or adjusted under 35 U.S.C. 154(b) by 252 days.

(21) Appl. No.: 15/735,483

(22) PCT Filed: Jun. 2, 2016

(86) PCT No.: PCT/EP2016/062508
§ 371 (c)(1),
(2) Date: Dec. 11, 2017

(87) PCT Pub. No.: WO2017/001139
PCT Pub. Date: Jan. 5, 2017

(65) Prior Publication Data

US 2018/0156038 A1 Jun. 7, 2018

(30) Foreign Application Priority Data

Jul. 2, 2015 (DE) ..... 10 2015 212 419

(51) Int. Cl.
*F01D 5/14* (2006.01)
*B22F 5/04* (2006.01)
(Continued)

(52) U.S. Cl.
CPC ..... *F01D 5/147* (2013.01); *B22F 5/04* (2013.01); *F01D 5/18* (2013.01); *F01D 5/282* (2013.01);
(Continued)

(58) Field of Classification Search
CPC . F01D 5/147; F01D 5/18; F01D 5/282; F01D 5/284
See application file for complete search history.

(56) References Cited

U.S. PATENT DOCUMENTS 3,301,526 A 1/1967 Chamberlain
3,378,228 A 4/1968 Twiston
(Continued)

FOREIGN PATENT DOCUMENTS

DE 1476921 U 10/1939
DE 1476921 B 3/1970
(Continued)

OTHER PUBLICATIONS

JP S 58-172406, Engilsh Translation of Specification, Espacenet (Year: 1983).*
(Continued)

*Primary Examiner* — Nathaniel E Wiehe
*Assistant Examiner* — John S Hunter, Jr.
(74) *Attorney, Agent, or Firm* — Wolter Van Dyke Davis, PLLC

(57) ABSTRACT

An arrangement for a turbine has a metallic support structure having at least one radial support strut and a multiplicity of plate-shaped, fiber-reinforced ceramic segments which are arranged one on top of the other on the support structure and together define the circumferential contour, the segments being provided with through-openings through which the at least one support strut extends, wherein the at least one support strut has outwardly-extending projections that extend perpendicular to the radial direction and engage in corresponding recesses formed in the segments.

18 Claims, 3 Drawing Sheets

(51) Int. Cl.
*F01D 5/28* (2006.01)
*F01D 5/18* (2006.01)

(52) U.S. Cl.
CPC ..... *F01D 5/284* (2013.01); *F05D 2220/32* (2013.01); *F05D 2230/31* (2013.01); *F05D 2230/311* (2013.01); *F05D 2230/51* (2013.01); *F05D 2230/64* (2013.01); *F05D 2260/30* (2013.01); *F05D 2300/603* (2013.01); *F05D 2300/6032* (2013.01); *F05D 2300/614* (2013.01)

(56) References Cited

U.S. PATENT DOCUMENTS

| | | | |
|---|---|---|---|
| 5,820,337 | A | 10/1998 | Jackson et al. |
| 2006/0120871 | A1 | 6/2006 | Thompson |
| 2006/0120874 | A1 | 6/2006 | Burke et al. |
| 2006/0121265 | A1 | 6/2006 | Thompson et al. |
| 2007/0020105 | A1 | 1/2007 | Albrecht et al. |
| 2011/0052412 | A1 | 3/2011 | Ader et al. |
| 2013/0171426 | A1 | 7/2013 | de Diego et al. |

FOREIGN PATENT DOCUMENTS

| | | | |
|---|---|---|---|
| DE | 102006049216 | A1 | 4/2008 |
| JP | S54102412 | A | 8/1979 |
| JP | S58172406 | A | 10/1983 |
| JP | 2013139374 | A | 7/2013 |
| WO | 2016085654 | A1 | 6/2016 |

OTHER PUBLICATIONS

NPL_20101124_RobotManufacturing, Rober Lamb, Nov. 24, 2010 (Year: 2010).*

DE Search Report dated Mar. 11, 2016, for DE patent application No. 102015212419.3.

International Search Report dated Aug. 19, 2016, for PCT/EP2016/062508.

IPRP (PCT/IPEA/ 416 and 409) dated May 24, 2017, for PCT/EP2016/062508.

* cited by examiner

ARRANGEMENT FOR A TURBINE

CROSS REFERENCE TO RELATED APPLICATIONS

This application is the US National Stage of International Application No. PCT/EP2016/062508 filed Jun. 2, 2016, and claims the benefit thereof. The International Application claims the benefit of German Application No. DE 102015212419.3 filed Jul. 2, 2015. All of the applications are incorporated by reference herein in their entirety.

FIELD OF INVENTION

The invention relates to an arrangement for a turbomachine, especially a turbine, such as a gas turbine, comprising a metal support structure which has at least one support strut which extends in a radial direction, and a multiplicity of segments which are arranged one on top of the other on the support structure, are of plate-like design, and are produced from a ceramic fiber composite material, which segments together define the circumferential contour of the arrangement, wherein the segments are provided with through-openings through which the at least one support strut extends. The present invention also relates to a method for producing such an arrangement.

BACKGROUND OF INVENTION

Arrangements of the type referred to in the introduction are known in a wide variety of embodiments in the prior art. Therefore, for example US 2006/00120871 A1 discloses a blade arrangement with a blade airfoil which consists of a multiplicity of segments which are arranged one on top of the other in the radial direction, are of plate-like design and consist of a ceramic fiber composite material. The individual blade airfoil segments comprise in each case through-openings, in alignment with each other, through which extend support struts, for example in the form of metal tie rods which press the blade airfoil segments against each other, as a result of which a force flux is created between the blade airfoil segments, holding these together. One problem of such a blade construction, however, consists in the fact that the blade airfoil segments can be displaced relative to each other in a direction transversely to the radial direction despite the radial pressure forces which act upon these. Accordingly, it may be necessary to provide additional means in order to prevent such relative movements. Therefore, for example inter-engaging projections and recesses can be provided on the upper and lower sides of the individual blade airfoil segments, which for production engineering reasons, however, is associated with a very large expenditure. In this connection, reference may be made by way of example to US 2006/0120874 A1. A further disadvantage which accompanies the use of tie rods consists in the fact that those through-openings through which a tie rod extends cannot normally be used as cooling passages, which in principle would be desirable.

SUMMARY OF INVENTION

Starting from this prior art, it is an object of the present invention to create an arrangement of the type referred to in the introduction with an alternative construction.

For achieving this object, the present invention creates an arrangement of the type referred to in the introduction which is characterized in that at least one, for example a number of, support strut(s) has/have at least one outwardly protruding projection, extending transversely to the radial direction, which engages, or can engage, in at least one correspondingly designed recess on at least one of the segments.

Advantageously, both a multiplicity of projections, for example a number of projections, are correspondingly provided on the support struts and a multiplicity of recesses, for example a number of recesses, in which the projections are to engage, are formed.

For achieving this object, the present invention can create a blade arrangement of the type referred to in the introduction which is characterized in that the at least one support strut has outwardly protruding projections, extending transversely to the radial direction, which engage in correspondingly designed recesses on the blade airfoil segments.

Owing to such projections and recesses, segments are connected directly to the at least one support strut without the use of separate fastening means, as a result of which a relative movement of the corresponding segments in a direction transversely to the radial direction is effectively prevented.

According to one embodiment of the present invention, the support structure has a plurality of support struts, especially three support struts, wherein provision can naturally also be made for a number of support struts which differs from this. Overall, by providing a plurality of support struts a very stable arrangement is achieved.

The at least one support strut advantageously has a non-round cross section, especially a cross section which follows the circumferential contour of the arrangement. Such a selection of the cross section is also very beneficial to the stability of the arrangement.

The at least one support strut is advantageously of hollow design. In this case, a cooling fluid can be directed through the support strut during the specified use of the arrangement so that the at least one support strut defines a cooling passage.

According to one embodiment of the present invention, the support strut has a platform, extending basically parallel to the segments, from which the at least one support strut projects radially outward, wherein the segments are stacked on the platform. Such a platform on the one hand interconnects the support struts if provision is made for a plurality of support struts. On the other hand, the platform defines a defined base upon which the segments can be stacked. Furthermore, such a platform can be provided with a blade root or be designed in one piece with such, which blade root serves for the fastening of the arrangement on a turbine component.

A defined annular gap is advantageously formed between the at least one support strut and those through-openings of the segments through which this extends. Such an annular gap provides sufficient space in case the segments thermally expand during the specified use of the arrangement in order to avoid the development of detrimental thermal stresses.

According to one embodiment of the present invention, the recesses extend in each case from an upper side of the respective segment. This has the result that the projections can be produced in a simple manner, as is explained in more detail below.

The at least one recess, or number of, or plurality of recesses, are advantageously designed in the form of chamfers which extend for example along the circumference of a through-opening.

The at least one projection, or the multiplicity of projections, is/are advantageously accommodated in the corresponding recess or recesses in a basically form-fitting manner. In this way, a particularly good cohesion between the at least one support strut and the segments is achieved.

Each segment is advantageously provided with at least one recess in which an associated projection engages, or can engage. In other words, each segment is connected to the at least one support strut in the case of this embodiment.

According to one variant of the present invention, the outer surfaces of the at least one segment, or segments, are provided with a coating, especially with a thermal barrier coating.

According to one embodiment, the arrangement is an arrangement for a turbine blade, especially a blade airfoil, or an arrangement for a part for the turbine exposed to hot gas impingement.

The arrangement can be a blade airfoil arrangement for a turbine, especially a gas turbine.

The arrangement can also be a ring segment arrangement for a turbine, especially a gas turbine.

The arrangement can also be an arrangement for another part in the gas path and/or steam path of a turbine, for example a part of a gas turbine exposed to hot gas impingement.

For achieving the object referred to in the introduction, the present invention also creates a method for producing an arrangement according to the invention, wherein the method is characterized in that at least the support struts of the support structure are produced using a generative method. In this case, it can be for example an SLM method (Selective Laser Melting), a flame spraying method, a high speed flame spraying method or a deposition welding method, to name just a few examples.

A stacking of the segments and a stepwise production of the at least one support strut advantageously alternate with each other in such a way that after an arranging of a segment which is provided with a recess, a section of the at least one support strut, including a projection engaging in the recess, is generated. In this way, the projections which engage in the recesses can be produced without any problem. Also, the realization of a form fit between the projections and the recesses poses no problems whatsoever.

The stacking of the segments is advantageously carried out using a robot. In this way, the entire production process of the arrangement can be conducted with a high degree of automation.

The outer surfaces of the segments are advantageously provided with a coating, especially with a thermal barrier coating, wherein the coating is advantageously provided afterwards.

BRIEF DESCRIPTION OF THE DRAWINGS

Further features and advantages of the present invention become clear based on the following description of an arrangement according to an embodiment of the present invention with reference to the attached drawing. In the drawing.

DETAILED DESCRIPTION OF INVENTION

Figure 1:
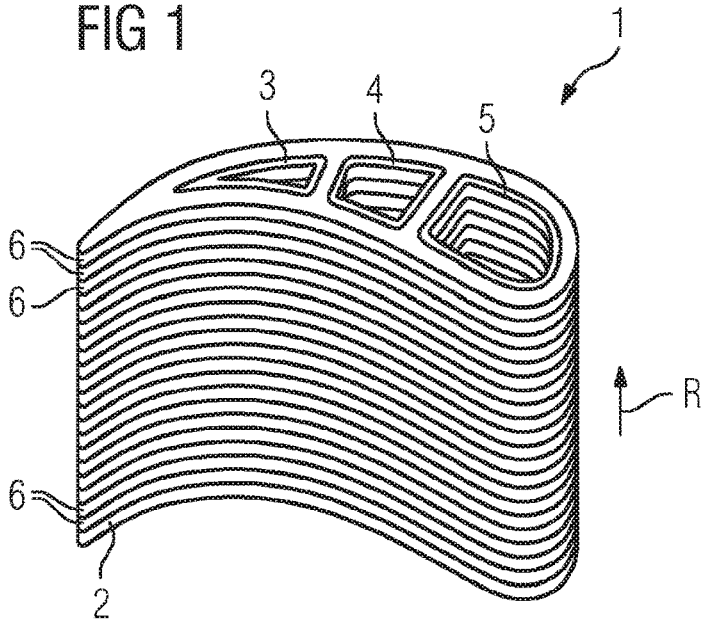
FIG. 1 shows a schematic perspective view of an arrangement according to an embodiment of the present invention.
Figure 2:
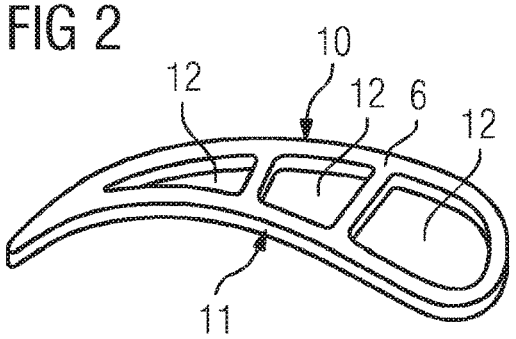
FIG. 2 shows a schematic plan view of a segment of the arrangement shown in FIG. 1.
Figure 3:
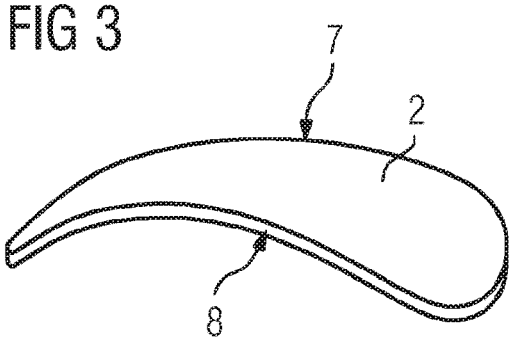
FIG. 3 shows a schematic plan view of a platform of a support strut of the arrangement shown in FIG. 1 and FIGS. 4 to 7 show schematic sectioned views, on the basis of which is explained the production of the arrangement shown in FIG. 1 using a method according to an embodiment of the present invention.

FIGS. 1 to 3 show an arrangement 1 according to an embodiment of the present invention or components thereof. The arrangement 1 is an arrangement for a turbine, especially a gas turbine, wherein the arrangement 1 can in principle be designed both as a rotor blade, as a stator blade and/or as a ring segment or another part in the gas path or steam path of a turbine, although this is not shown in more detail in the present case.

As main components, the arrangement 1 comprises a metal support structure, with a platform 2, and three support struts 3, 4 and 5, which extend from the platform 2 in a radial direction R, and a multiplicity of segments 6 which are arranged one on top of the other on the support structure and are of plate-like design, which segments together define the circumferential contour of the arrangement.

The support structure, which principally serves for absorbing and dissipating forces which act upon the arrangement 1 during the specified use of this, is produced from a metal material which for example consists of a nickel based alloy, to name just one example. The platform 2 has a basically convexly curved suction side 7 and a basically concavely curved pressure side 8, wherein in principle other geometries are possible. In the case of the platform 2, it can be a prefabricated component which has been produced for example by means of casting and subsequent mechanical machining. Alternatively, the platform 2 can also be produced using a generative production method, such as by means of an SLM method, wherein other generative production methods are naturally also possible. The support struts 3, 4 and 5 are produced using a generative production method and fixedly connected to the platform 2, as is explained in more detail below. The struts extend from the platform 2 basically parallel to each other, are of hollow design, and in the present case have a non-round cross section in each case which follows the circumferential contour of the arrangement in the present case. Level with the upper edge of each segment 6, the support struts 3, 4 and 5 are circumferentially provided in each case with outwardly protruding projections 9 which extend transversely to the radial direction.

The segments 6 are produced in each case from a ceramic fiber composite material. Used as the ceramic fiber composite material can be for example $Al_2O_3$, $2O_3/Al_2O_3$, C/SiC, Sic/SiC or the like, to name just a few examples. Similar to the platform 2, the segments 6 comprise a suction side 10 and a pressure side 11, wherein the outer contours of adjacently arranged segments 6 are advantageously designed in alignment with each other, just as the outer contour of the platform 2 aligns with the outer contour of the adjacent arranged segment 6 in the present case. The segments 6 are provided in each case with three through-openings 12 through which the respective support struts 3, 4 and 5 extend. Between the segments 6 and the support struts 3, 4 and 5, a defined annular gap, which is broken only by the projections 9, can be left. Such an annular gap can be advantageous during the specified use of the arrangement 1 to the effect that in case of thermal expansions of the support struts 3, 4 and 5 and/or of the segments 6 a measured expansion space is created, reducing or preventing the occurrence of thermal stresses. Starting from the upper side of each segment 6 provision is made for encompassing recesses 13 of chamfer-like design which extend along the edge regions of the respective through-openings 12. The projections 9, which protrude from the support struts 3, 4 and 5, engage in these recesses 13 in a form-fitting manner so that each segment 6 is fixedly connected to the support struts 3, 4 and 5. For producing the arrangement 1 shown in FIG. 1, in a first step, as is shown schematically in FIG. 4, the platform 2 of the support structure is arranged on the base. After that, a segment is positioned on the platform 2 in such a way that the outer contour of the segment 6 aligns with the outer contour of the platform 2. The positioning of the segment can in this case be carried out using a robot, although this not shown in the present.

Figure 4:
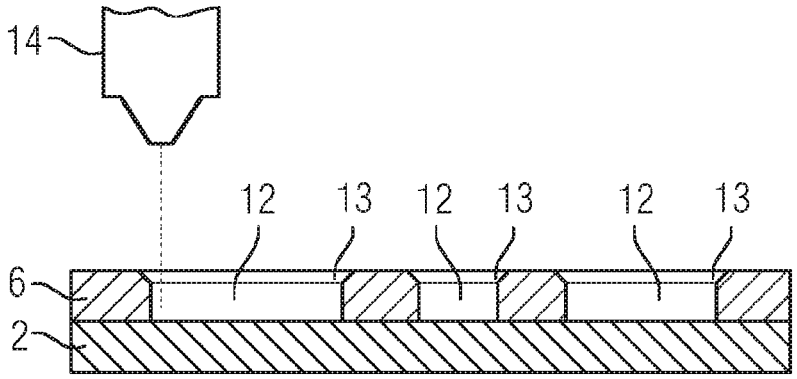
Figure 5:
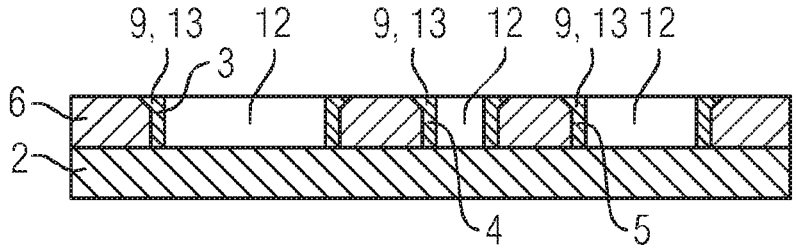

In a further step, sections of the support struts 3, 4 and 5 are generated in layers along the circumference of the respective through-openings 12 on the platform 2 up to the upper edge of the segment 6 using a generative production method, wherein the recesses 13 are also filled with metal material, creating the projections 9, as is shown in FIG. 5. In this connection, FIG. 4 schematically shows a nozzle arrangement 14 by means of which powdered metal material is directed in the direction of the platform 2 and is melted using a laser. It should be obvious that in principle any generative LMD method (Laser-Metal Deposition) can be used.

Figure 6:
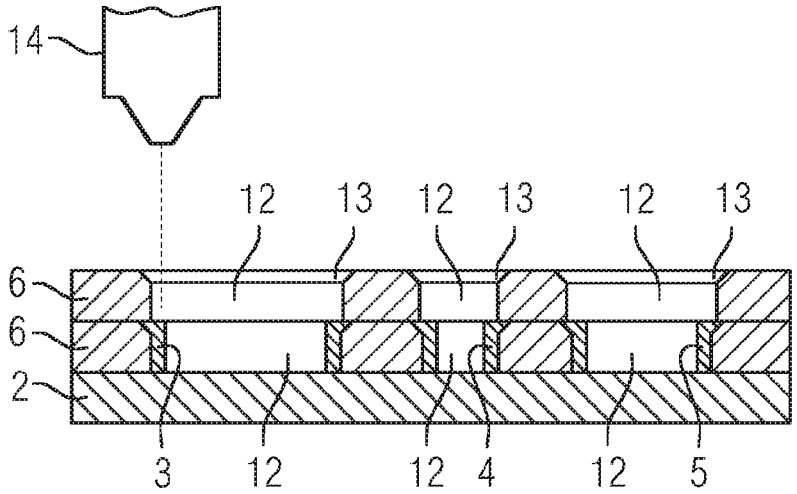
Figure 7:
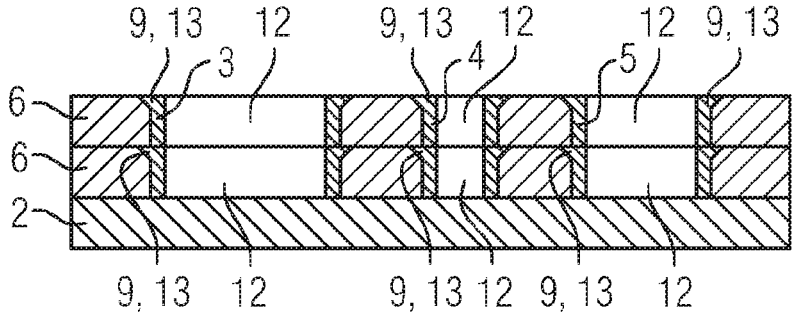

In a subsequent step, as is shown in FIG. 6, a further segment 6 is positioned on the segment 6 which is already fastened on the platform 2, whereupon sections of the support struts 3, 4 and 5 are again generated in layers—see FIG. 7. The previously described steps are repeated until the arrangement 1 shown in FIG. 1 is completed. In other words, a stacking of the segments 6 and a layered production of the support struts 3, 4 and 5 alternate, wherein after an arranging of a segment 6 which is provided with a recess 13, a section of the support struts 3, 4 and 5, including a projection 9 which engages in the recess 13, is generated in each case.

After completion of the arrangement 1 shown in FIG. 1, an uppermost metal cover layer, which can be provided with cooling fluid discharge holes and produced for example by means of deposition welding, can be arranged for forming a blade tip. Alternatively, a prefabricated cover layer can also be fixed on the metal support structure by means of high temperature soldering or the like. The arrangement 1 shown in FIG. 1 can also be provided with a coating, for example with a thermal barrier coating, if this is desired.

An essential advantage of the method according to the invention consists in the fact that during the production of a hybrid arrangement 1 the individual segments 6 are connected in a fixed and secure manner to the support structure in all spatial directions without separate fastening means being required for it.

Although in the views of the figures each segment can be provided with a recess, it is sufficient for the inventive idea if this is this case only for at least one of, or a number of, the segments, for example two, three or four segments. Consequently, according to the present invention only at least one corresponding support strut or the stated multiplicity has to have a corresponding projection.

For example, the engaging connection by means of the projections and the recesses in the middle of the arrangement or in every third or fourth stacked segment of the arrangement can be sufficient in order to utilize the advantages according to the invention.

Although the invention has been fully illustrated and described in detail by means of the preferred exemplary embodiments, the invention is not limited by the disclosed examples and other variations can be derived therefrom by the person skilled in the art without departing from the extent of protection of the invention.

The invention claimed is:

1. An arrangement for a turbine, comprising:

a metal support structure comprising at least one support strut comprising a longitudinal axis, and a multiplicity of segments arranged in a stack on the metal support structure, wherein each segment of the multiplicity of segments comprises a flat shape comprising a thickness along the longitudinal axis and a width that extends along a second axis that is transverse to the longitudinal axis, wherein the width is greater than the thickness, and wherein each segment comprises a ceramic fiber composite material, wherein the multiplicity of segments together define at least one part of a circumferential contour of the arrangement, wherein each segment of the multiplicity of segments comprises a through-opening, wherein in the stack the through-openings align to form a first stack opening of through-openings that extends along the longitudinal axis, and wherein a first support strut of the at least one support strut is disposed within the stack of through-openings and extends along the longitudinal axis thereby passing through at least two of the through-openings, and wherein the first support strut comprises at least one outwardly protruding projection extending along the second axis, wherein the at least one outwardly protruding projection engages in at least one correspondingly designed recess on at least one segment of the multiplicity of segments.

2. The arrangement as claimed in claim 1, wherein the at least one support strut further comprises a second support strut that extends along the longitudinal axis and a third support strut that extends along the longitudinal axis, wherein the second support strut and the third support strut are positioned at different locations along the second axis, wherein each segment of the multiplicity of segments further comprises a second through-opening and a third through-opening, wherein in the stack the second through-openings align to form a second stack opening which extends along the longitudinal axis and through which the second support strut extends along the longitudinal axis thereby passing through at least two of the second through-openings, and wherein in the stack the third through-openings align to form a third stack opening which extends along the longitudinal axis and through which the third support strut extends along the longitudinal axis thereby passing through at least two of the third through-openings.

3. The arrangement as claimed in claim 1, wherein the first support strut comprises a non-round cross section.

4. The arrangement as claimed in claim 3, wherein the at least one support strut comprises a cross section which follows the circumferential contour of the arrangement.

5. The arrangement as claimed in claim 1, wherein the first support strut is hollow.

6. The arrangement as claimed in claim 1, wherein the metal support structure comprises a platform which extends parallel to the multiplicity of segments, wherein the at least one support strut extends along the longitudinal axis from the platform, and wherein the multiplicity of segments are stacked on the platform.

7. The arrangement as claimed in claim 1, wherein each correspondingly designed recess of the at least one correspondingly designed recess forms a respective annular gap surrounding the first support strut.

8. The arrangement as claimed in claim 1, wherein each correspondingly designed recess of the at least one correspondingly designed recess is recessed into an upper side of a respective segment of the at least one segment.

9. The arrangement as claimed in claim 8, wherein each correspondingly designed recess comprises a chamfer where the upper side meets the through-opening.

10. The arrangement as claimed in claim 1, wherein each projection of the at least one outwardly protruding projection engages in a respective correspondingly designed recess of the correspondingly designed recess in a form-fitting manner.

11. The arrangement as claimed in claim 1, wherein each segment of the multiplicity of segments comprises a respective correspondingly designed recess of the at least one correspondingly designed recess with which a respective outwardly protruding projection of the at least one outwardly protruding projection engages.

12. The arrangement as claimed in claim 1, further comprising a coating disposed on respective outer surfaces of some segments of the at least one segment.

13. The arrangement as claimed in claim 12, wherein the coating comprises a thermal barrier coating.

14. The arrangement as claimed in claim 1, wherein the arrangement is an arrangement for a turbine blade, or is an arrangement for a part for the turbine which is exposed to impingement by hot gas.

15. The arrangement as claimed in claim 1, wherein the arrangement is an arrangement for a blade airfoil, or is an arrangement for a ring segment for the turbine which is exposed to impingement by hot gas.

16. A method for producing the arrangement as claimed in claim 1, the method comprising:

using a generative method to produce at least the at least one support strut of the metal support structure.

17. The method as claimed in claim 16, wherein the stack comprises plural layers, each layer of the plural layers comprising a respective segment and a respective portion of the first support strut, the method further comprising:

forming each layer of the stack sequentially, wherein in at least one layer of the plural layers comprises the respective segment comprises a respective outwardly protruding projection of the at least one outwardly protruding projection.

18. The method as claimed in claim 17, further comprising using a robot to position each segment.

* * * * *